United States Patent [19]

Hunter et al.

[11] Patent Number: 4,896,076

[45] Date of Patent: Jan. 23, 1990

[54] BINARY AND TERNARY GAS MIXTURES FOR USE IN GLOW DISCHARGE CLOSING SWITCHES

[75] Inventors: Scott R. Hunter; Loucas G. Christophorou, both of Oak Ridge, Tenn.

[73] Assignee: The United States of America as represented by the United States Department of Energy, Washington, D.C.

[21] Appl. No.: 186,856

[22] Filed: Apr. 27, 1988

[51] Int. Cl.[4] ..... H05B 37/02

[52] U.S. Cl. ..... 315/150; 315/358; 313/637; 313/589; 313/643; 372/86

[58] Field of Search ..... 315/150, 358; 313/637, 313/589, 643; 372/86

[56] References Cited

U.S. PATENT DOCUMENTS

| | | | |
|---|---|---|---|
| 3,398,321 | 11/1961 | Langberg | 313/643 |
| 4,063,130 | 12/1977 | Hunter | 315/150 |
| 4,490,650 | 12/1984 | Christophorou et al. | 315/150 |
| 4,751,428 | 6/1988 | Christophorou et al. | 313/637 |
| 4,792,724 | 12/1988 | Christophorou et al. | 313/637 |

OTHER PUBLICATIONS

Christophorou et al., "Gas Engineering Studies for High Pressure Self-Sustained Diffuse Discharge Closing Switches", Gaseous Dielectrics V, Pergamon Press.

S. R. Hunter et al., "New Concepts for High Current Self-Sustained Diffuse Discharge Closing Switches", Proceedings of the 6th IEEE Pulsed Power Conference, Arlington, Va., Jun. 29–Jul. 1.

S. R. Hunter et al., "Electron Transport Studies of Gaseous Media for Diffuse Discharge Closing Switches", Proceedings of the XVIII Inter. Conf. on Phenomena in Ionized Gases, UK, Jul. 13–17.

*Primary Examiner*—Eugene R. Laroche
*Assistant Examiner*—Than-Truc Nguyen
*Attorney, Agent, or Firm*—Stephen D. Hamel; William R. Moser; Richard E. Constant

[57] ABSTRACT

Highly efficient binary and ternary gas mixtures for use in diffuse glow discharge closing switches are disclosed. The binary mixtures are combinations of helium or neon and selected perfluorides. The ternary mixtures are combinations of helium, neon, or argon, a selected perfluoride, and a small amount of gas that exhibits enhanced ionization characteristics. These mixtures are shown to be the optimum choices for use in diffuse glow discharge closing switches by virtue of the combined physio-electric properties of the mixture components.

7 Claims, 5 Drawing Sheets

BINARY AND TERNARY GAS MIXTURES FOR USE IN GLOW DISCHARGE CLOSING SWITCHES

The present invention was developed during work on a contract with the Department of Energy, and therefore, the Government has rights in this invention.

FIELD OF THE INVENTION

The present invention relates, in general, to the art of switches, and in particular, to the art of glow discharge switches. Specifically, the present invention relates to a gas mixture used in glow discharge closing switches used in capacitive energy storage circuits.

BACKGROUND OF THE INVENTION

In certain applications, such as high-power microwave sources, pulsed lasers, particle beam generators, nuclear event simulators, and directional energy weapons, and the like, it is necessary to store electrical energy for release in pulses having extremely fast rise times (e.g., $\lesssim$10 nanoseconds) and short durations (100 nanoseconds to microseconds).

High current self-sustained diffuse glow discharges are suitable for use in high voltage pulsed power applications where fast closing, high repetition rate switching is required. A schematic showing the operation of a UV light triggered glow discharge closing switch in a capacitive energy storage circuit is shown in FIG. 1. The major problems that have been encountered with this type of switch are the high impedance of the discharge and the instabilty of the glow discharge which leads to the formation of electrical arcs between the switch electrodes and consequently destroys the repetitive operation of the switch. The voltage waveform that appears across the switch electrodes is shown schematically in FIG. 2. The present invention describes gas mixtures which will lower the switch voltage $V_s$ (i.e., increase the switch efficiency) and similarly maintain the discharge at the operating voltage $V_s$ and thereby increasing the stability of the discharge.

It has been found by the present inventors that the physio-electrical properties of the gases used in these switches were leading to the unstable high impedance (low efficiency) glow discharges resulting in poor switching characteristics.

Accordingly, there is need for a gas mixture for use in such switches that not only has the capability for conducting a large amount of energy between the electrodes of a diffuse-discharge switch when the switch is in a conducting mode and which has a high insulating capability when the switch is in a nonconducting mode, but also has the capability of providing stable glow discharges during the switch conduction.

The physio-chemical properties required of the gas mixture to achieve high efficiency, stable, discharge operation were discussed in detail for the first time in S. R. Hunter, L. G. Christophorou, and J. G. Carter, "Gas Engineering Studies for High Pressure Self-Sustained Diffuse Discharge Closing Switches." In *Gaseous Dielectrics* V Edited by L. G. Christophorou and D. W. Bouldin, Pergamon Press, New York, p. 404 (1987); S. R. Hunter, L. G. Christophorou, J. G. Carter, and P. G. Datskos, "New Concepts for High Current Self-Sustained Diffuse Discharge Closing Switches" to be published in the *Proceedings of the 6th IEEE Pulsed Power Conference,* Arlington, VA, June 29–July 1, 1987; and S. R. Hunter, J. G. Carter, and L. G. Christophorou, "Electron Transport Studies of the Gaseous Media for Diffuse Discharge Closing Switches," Published in *Proceeding of the XVIII International Conference on Phenomena on Ionized Gases,* Swansea, United Kingdom, July 13–17, 1987, the disclosures of which are all incorporated herein by reference thereto. The stability of the glow discharge is enhanced by tailoring the electron attachment coefficient ($\eta$/N) and the ionization coefficient ($\alpha$/N) of the gas mixture in such a way that the rate of change in the electron production and loss is minimal during small perturbations of the applied electric field beyond the glow discharge operating voltage level $V_s$.

The invention disclosed in the co-pending application by the same inventors, the disclosure of which is incorporated herein by reference thereto as L. G. Christophorou and S. R. Hunter, "Binary and Ternary Gas Mixtures with Temperature Enhanced Diffuse Glow Discharge Characteristics for Use in Closing Switches", U.S. patent application filed concurrently herewith by the same inventors (DOE No. ESID 368-Z), discusses various gases which exhibit decreasing electron attachment with increasing temperature for increasing the efficiency of the conductance of the glow discharge and further inhibits the formation of an arc.

However, increased efficiency and stability during the diffuse glow discharge is still needed to further enhance the desirable characteristics of this type of switch.

OBJECTS OF THE INVENTION

It is a main object of the present invention to provide an improved diffuse-discharge switch system for use in generating high-energy electrical pulses.

It is another object of the present invention to provide a diffuse-discharge switch having a gas mixture therein which conducts a large amount of electrical energy when initiated by an ultraviolet light but which serves as an effective insulator when not activated by the light source.

It is another object of the present invention to provide gas mixtures that will increase the efficiency to a diffuse glow discharge closing switch.

It is another object of the present invention to provide gas mixtures for use in a glow discharge switch which improve the stability of the diffuse glow discharge during the conducting stage of a diffuse glow discharge closing switch.

It is another object of the present invention to provide gas mixtures for use in a glow discharge closing switch that will inhibit arc formation.

It is another object of the present invention to provide gas mixtures for use in a glow discharge closing switch which will exhibit low resistivity during the conducting stage of operation of the switch.

It is another object of the present invention to provide gas mixtures for a glow discharge closing switch that exhibit fast recovery characteristics during the opening stage of operation.

SUMMARY OF THE INVENTION

These, and other, objects are accomplished by the present invention which is embodied in various gas mixtures that have physio-electrical properties that lead to stable low impedance glow discharges thereby to improve the switching characteristics of the system.

Most specifically, the present invention is embodied in two species, as follows:

A first compound selected from the group consisting of He, and Ne or a mixture thereof, in combination with a compound selected from the group consisting of $(CF_3)_2O$, $CF_4$, $BF_3$, $SiF_4$, $GeF_4$, and $PF_3$ or mixtures thereof; or a compound selected from the group consisting of He, Ne or Ar, or mixtures thereof, in combination with a compound selected from the group consisting of $(CF_3)_2O$, $CF_4$, $BF_3$, $GeF_4$, $WF_4$, $SiF_4$, and $PF_3$, or mixtures thereof, in combination with a compound selected from the group consisting of N,N,N',N'-tetramethyl-1,4-benzenediamine (TMPD); 1,1',3,3'-tetramethyl- Δ2,2' bi(imidazolidine) (TMBI); [tetrakis-(dimethyl)-amino]-ethylene (TMAE); N,N,N',N'-tetramethyl-p-phenylenediamine (TMAB); triethylamine; methylaniline; diethylamine; aniline; Co-ocene; Ch-ocene; Ni-ocene; and Fe-ocene.

DETAILED DESCRIPTION OF THE PREFERRED EMBODIMENTS

In the fast closing switch of the present type, once the discharge has been triggered by an externally produced electron source, the discharge is self-sustained. That is, it does not require an external source of ionization to maintain the discharge, and will continue until the charge on the capacitor is depleted. This is in contrast to an externally sustained diffuse discharge opening switch which is used in an inductive energy storage circuit to extract pulses of energy from an inductor. This latter switch concept was the subject of two previous inventions by the present inventors and is described in L. G. Christophorou and S. R. Hunter, "Gas Mixture for Diffuse-Discharge Switch. U.S. Pat. No. 4,063,130, and L. G. Christophorou and S. R. Hunter, "Ternary Gas Mixture for Diffuse Discharge Switch." U.S. Patent (to be issued), Ser. No. 884,857, the disclosures of which are fully incorporated herein by reference thereto. Although, both the self-sustained closing switch and the externally sustained opening switch rely on diffuse discharges, the operation, use, and hence the physio-chemical properties required of the gas mixtures in the two switches are very different.

Figure 1:
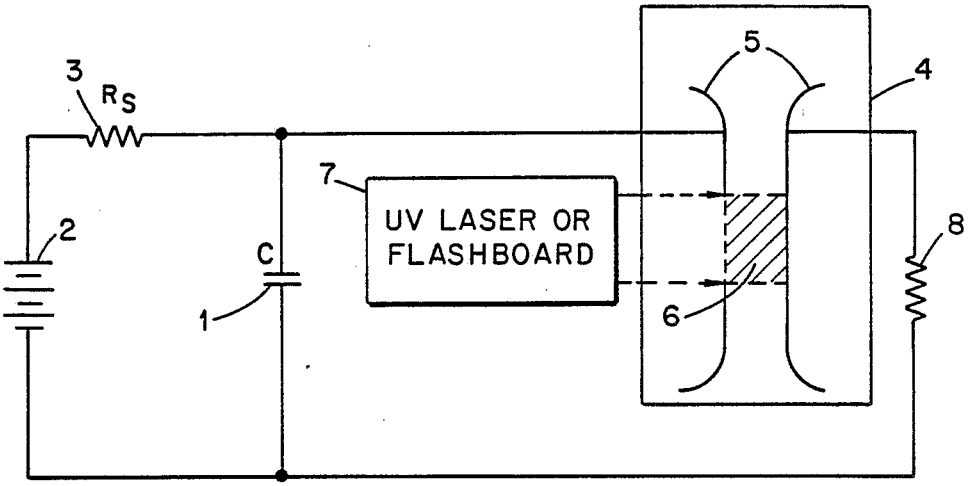
FIG. 1 is a schematic representation of a self-sustained diffuse glow discharge closing switch in a capacitive energy storage circuit in which the invention can be advantageously employed.
Figure 2:
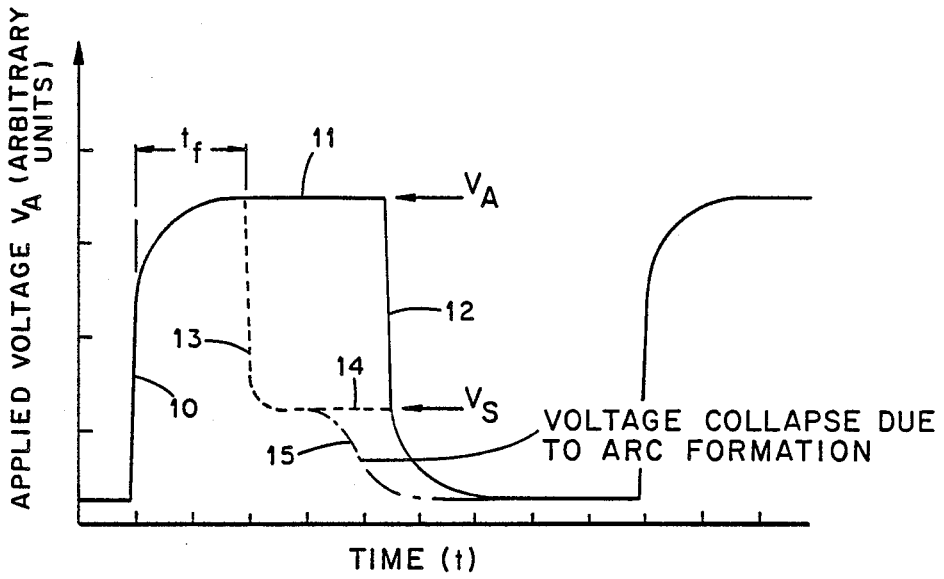
FIG. 2 is a schematic drawing showing the voltage-time characteristics for the repetitively operated closing switch shown in FIG. 1.

The basic requirements of a gaseous medium for use in a diffuse-discharge closing switch in a capacitive energy storage type pulse generating system can best be understood by consideration of the operation of the circuit illustrated in FIG. 1. A storage capacitor 1 is charged from a high voltage source 2 through an isolating resistor 3. A switch 4 contains one of the subject gas mixtures and contains two electrodes 5 separated by a light path 6. The gap 6 is illuminated by a short burst of UV radiation from a laser or UV flashlamp 7, which produces a uniform photoionization of one or more of the gas components. A fast or slow rising voltage pulse 10, See FIG. 2, is then applied across the electrodes which has the shape given by curves 10, 11 and 12. After a given time interval $t_f$ (the formative time lag required for the discharge to develop), a high current, uniform glow discharge is formed in the gap between the electrodes, and the voltage across the electrodes decreases (curve 13) and levels off at 14 until the capacitor 1 is discharged, and the voltage collapses, as indicated at 12, opening the switch.

With prior art gases, the diffuse glow discharge 13 quickly becomes constricted, the voltage falls off rapidly as indicated at 15, and a hot, low impedance arc may form. This degrades the repetitive operation of the switch.

The gas mixtures disclosed herein as embodying the invention, overcomes this problem and improve the operation of this type of switch.

Figure 3:
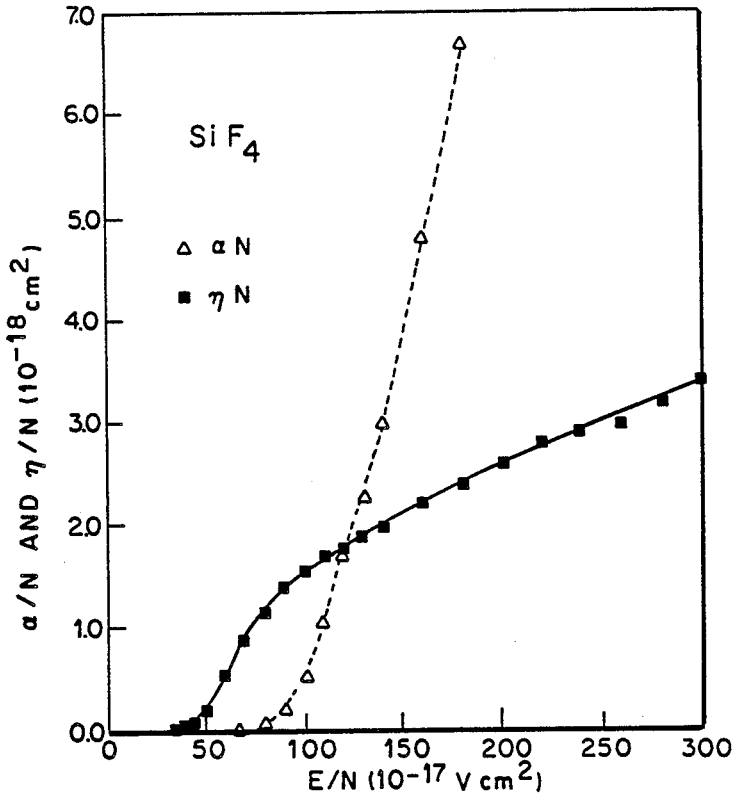
FIG. 3 is a graph of the electron attachment coefficient ($\eta$/N) and the electron ionization coefficient ($\alpha$/N) in $SiF_4$ as a function of the density normalized electric field strength (E/N).
Figure 4:
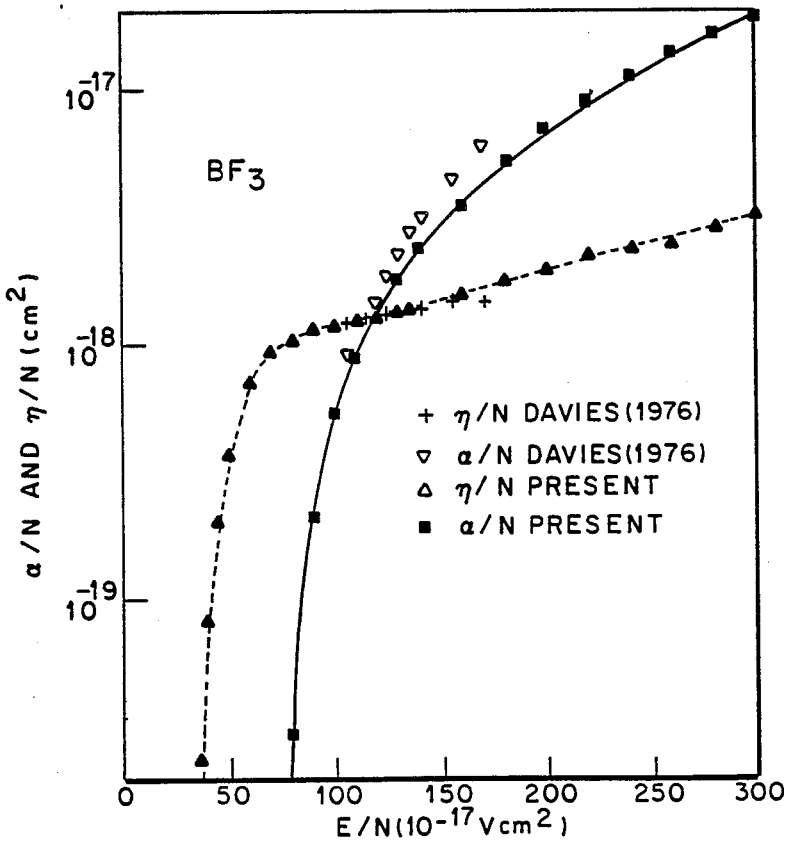
FIG. 4 is a graph of the electron attachment coefficient ($\eta$/N) and the electron ionization coefficient ($\alpha$/N) in $BF_3$ as a function of the density normalized electric field strength (E/N).

The stability of the diffuse glow discharge can be greatly improved by using gas mixtures in which the rate of change in the electron production and loss is minimal during small perturbations of the applied electric field $V_A$ (in FIG. 2). This is achieved by finding gases and gas mixtures in which the variation in electron attachment coefficient ($\eta$/N) and the electron ionization coefficient ($\alpha$/N) is small at (E/N) values near the operating E/N value. The operating E/N value is defined when the rate of electron loss by electron attachment is balanced by the rate of electron production by electron ionization and occurs when $(\alpha/N)=(\eta/N)$. Two examples of gases which possess these electron attachment and ionization characteristics are $SiF_4$ and $BF_3$, and their electron attachment coefficients and ionization coefficients are shown as a function of the applied electric field strength (E/N) in FIGS. 3 and 4 respectively.

Figure 5:
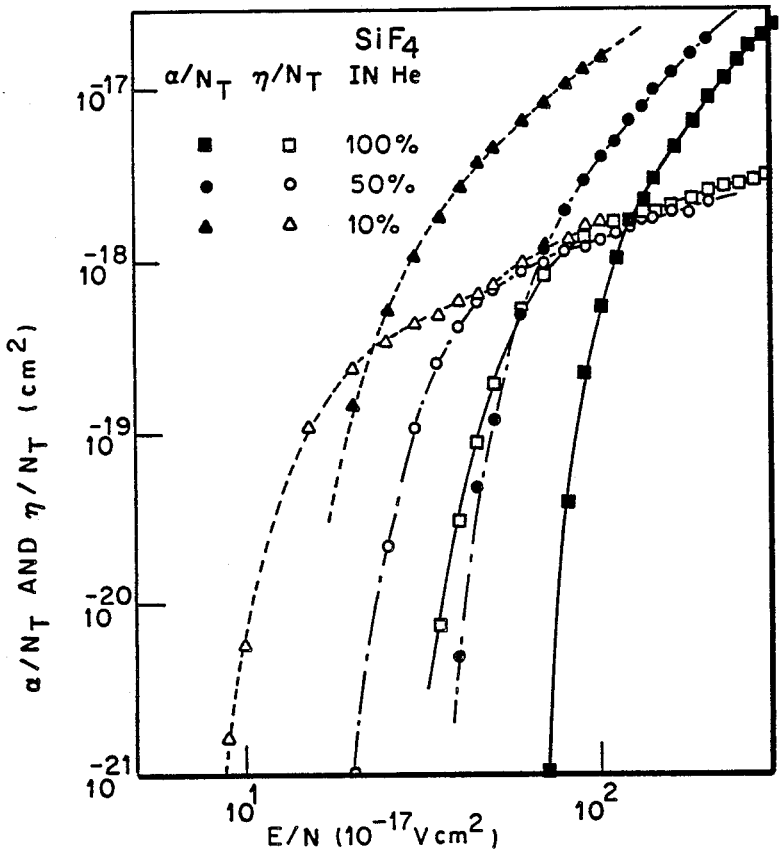
FIG. 5 is a graph of the total electron attachment coefficient ($\eta/N_T$) in various $SiF_4$/He gas mixtures as a function of E/N.
Figure 6:
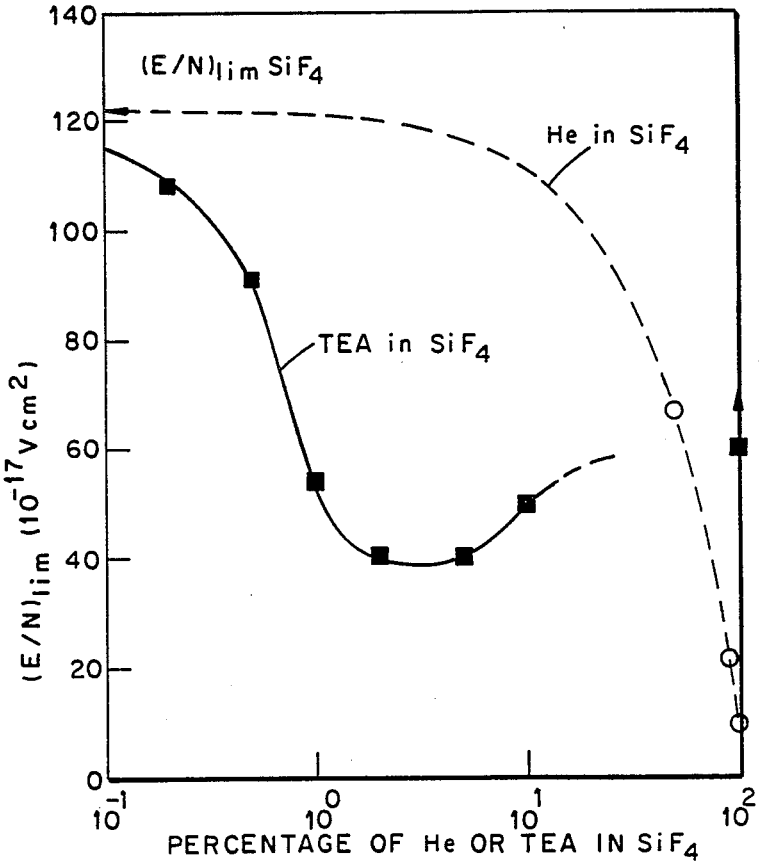
FIG. 6 is a graph of the total electron attachment coefficient ($\eta/N_T$) and the total electron ionization coefficient ($\alpha/N_T$) in various $SiF_4$/TEA gas mixtures as a function of E/N.
Figure 7:
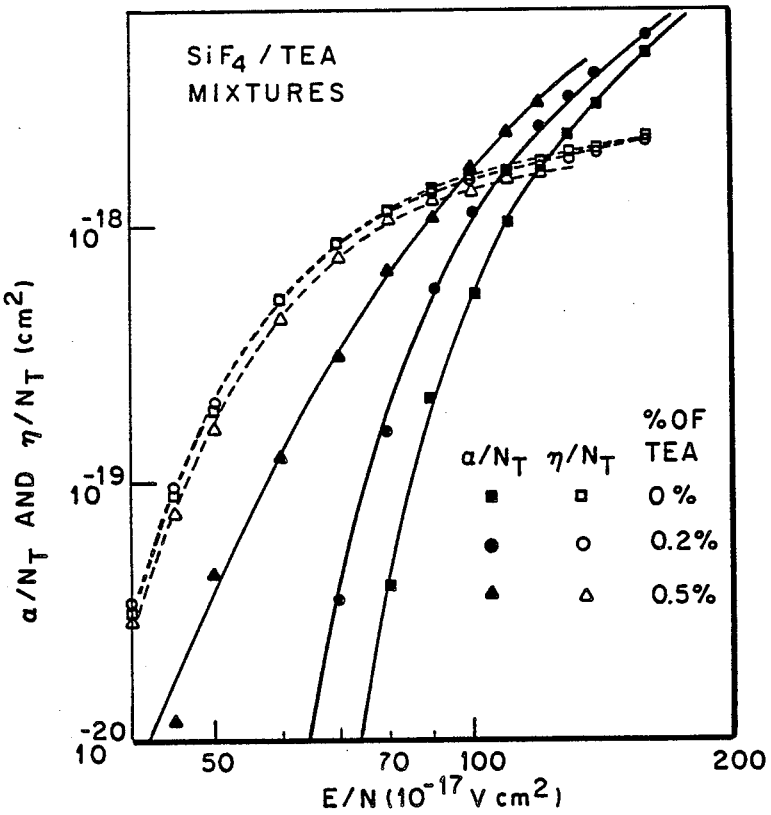
FIG. 7 is a plot of the operating electric field strength $(E/N)_{lim}$ in $SiF_4$/He and $SiF_4$/TEA gas mixtures as a function of the concentration of either He or TEA in $SiF_4$.

In order to reduce the operating voltage or electric field strength $(E/N)_{lim}$ of the switch to as low a value as possible, it is necessary to add to the perfluoride with the desirable electron attachment and ionization characteristics a buffer gas that is a rare gas chosen from He or Ne. An example of such a mixture is shown in FIG. 5 where the operating electric field $(E/N)_{lim}$ has been decreased by a factor of 2 by adding 50% of the He to the gas mixture. This is more clearly demonstrated in FIG. 6 where the operating electric field strength $(E/N)_{lim}$ is plotted as a function of the concentration of He in the $SiF_4$/He gas mixture. The addition of a low ionization threshold gas additive also has the effect of lowering $(E/N)_{lim}$ when added to the perfluoride gas mixture. This is demonstrated in the $SiF_4$/TEA gas mixtures in FIGS. 6 and 7 where it can be seen that the addition of 2% of TEA to the $SiF_4$/TEA gas mixture reduces the $(E/N)_{lim}$ by a factor of 3. The addition of either the rare gas or the low ionization threshold gas additive also has the beneficial effect of increasing the stability of the discharge by reducing the variation in the electron gain and loss process around the operating $(E/N)_{lim}$ as can clearly be seen in FIGS. 5 and 7.

The binary gas mixtures of the present invention are disclosed in Table I below. It is observed that the recommended concentrations of the attaching gas is 0.5 to 50% by volume, although more or less than this may work. A complete explanation of the physio-electric properties of these gases, and why they work when other gases fail is found in the papers referenced above.

TABLE I

| Binary Gas Mixtures |
|---|
| Attaching Gas (0.5 to 100%) |
| $(CF_3)_2O$ |
| $CF_4$ |
| $BF_3$ |
| $GeF_4$ |
| $WF_6$ |
| $SiF_4$ |
| $PF_3$ |
| Buffer Gas (balance) |
| He |
| Ne |

Figure 8:
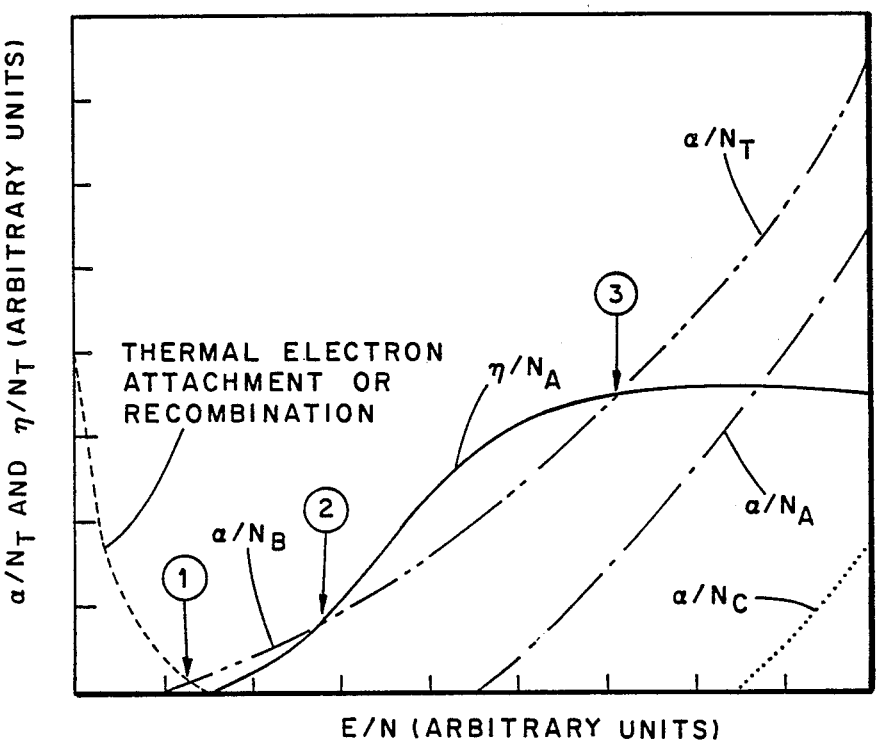
FIG. 8 is a schematic figure of the desirable electron attachment coefficient ($\eta/N_T$) and the electron ionization coefficient ($\alpha/N_T$) in the ternary gas mixtures for efficient self-sustained diffuse glow discharge closing switches.

Further improvements to the glow discharge closing switch efficiency and stability of the discharge can be obtained by finding ternary gas mixtures with the electron attachment and ionization coefficient characteristics outlined in FIG. 8. The essential features of the concept are to find gas mixtures which collectively possess ionization coefficients $(\alpha/N_B)$ at low E/N which are larger than the attachment coefficient $(\eta/N_A)$ over a given E/N range [i.e. between regions (1) and (2) in FIG. 8], while at higher E/N values, $\eta/N_A$ is larger than $\alpha/N_T$ [i.e. between regions (2) and (3) in FIG. 8]. Gas mixtures with these characteristics have a very low operating electric field strength [at (1) in FIG. 8] and are very stable against perturbations in the electric field.

Figure 9:
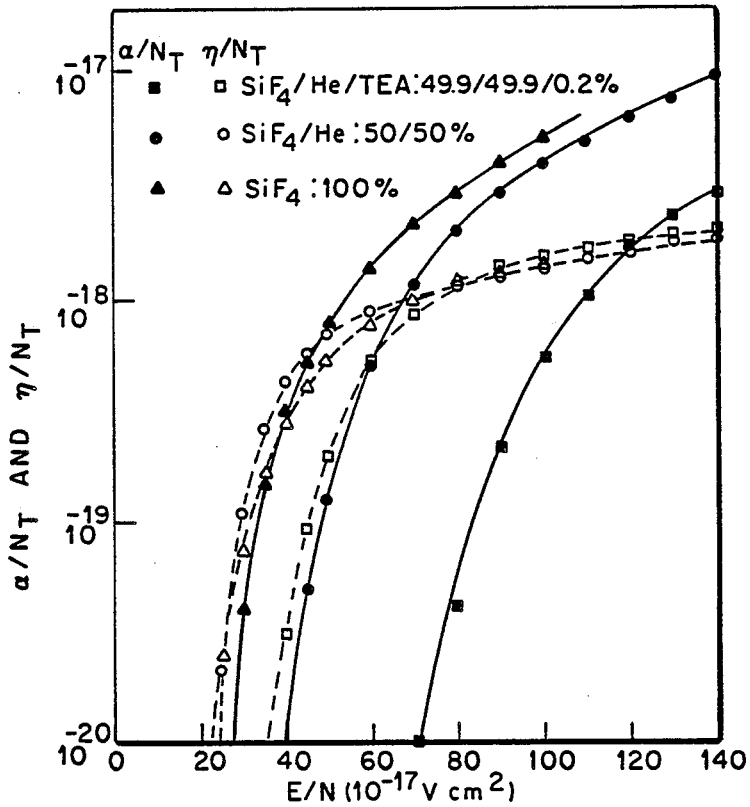
FIG. 9 is a schematic figure of the total electron attachment coefficient ($\eta/N_T$) and the total ionization coefficient ($\alpha/N_T$) in pure $SiF_4$, a 50/50 gas mixture of $SiF_4$/He and 49.9/49.9/0.2 ternary gas mixture of $SiF_4$/He/TEA.

To implement this concept, a ternary gas mixture with the following components is required. Component A is an electron attaching gas with a high electron attachment threshold ($\geqq$10 eV) and a high ionization threshold ($\geqq$15 eV). Its $\alpha/N_A$ and $\eta/N_A$ characteristics are shown in FIG. 8. Component B is a gas with a low ionization threshold ($\lesssim$8 eV) and a large electron impact ionization cross section. Its ionization coefficient $(\alpha/N_B)$ is shown in FIG. 8. Component C is a rare gas with a high ionization threshold energy ($\gtrsim$20 eV). The ionization coefficient $(\alpha/N_C)$ of this component is shown in FIG. 8. An example of a gas mixture possessing these characteristics is shown in FIG. 9 for $SiF_4$/He/TEA gas mixtures. A complete explanation of the properties of these gases and how they work is found in the above-mentioned references.

TABLE II

| Ternary Gas Mixtures | |
|---|---|
| Attaching Gas (0.5 to 100%) | |
| $(CF_3)_2O$ $CF_4$ $BF_3$ $GeF_4$ $WF_6$ $SiF_4$ $PF_3$ | |
| Ionizing Gas (0.01 to 5%) | |
| N,N,N',N'—Tetramethyl-1,4-benzenediamine (TMPD) | $C_6H_4[N(CH_3)_2]_2$ |
| 1,1',3,3'-Tetramethyl-Δ2,2'bi(imidazolidine) (TMBI) | $C_2H_4N_4(C_4H_8)_2$ |
| [Tetrakis-(dimethyl)-amino]-thylene (TMAE) | $[(CH_3)_2N]_4C_2$ |
| N,N,N',N'—Tetramethyl-p-phenylenediamine (TMAB) | $[(CH_3)_2N]_4C_4H_2$ |
| Triethylamine | $(C_2H_5)_3N$ |
| Methylaniline | $C_6H_5NHCH_3$ |
| Diethylamine | $(C_2H_5)_2NH$ |
| Aniline | $C_6H_5NH_2$ |
| Co—ocene | $(C_5H_5)_2Co$ |
| Ch—ocene | $(C_5H_5)_2Ch$ |
| Ni—ocene | $(C_5H_5)_2Ni$ |
| Fe—ocene | $(C_5H_5)_2Fe$ |
| Buffer Gas (balance) | |
| He Ne Ar | |

Both the ternary gas mixtures and the binary gas mixtures, although differing in working principles, each provides adequate performance to satisfy the objects of this invention.

It is to be understood that while certain forms of the present invention have been illustrated and described herein, it is not to be limited to the specific forms or arrangement of parts described and shown.

We claim:

1. A capacitive energy storage system comprising:
a self-sustained diffuse-discharge closing switch;
a gas mixture in said diffuse-discharge switch comprising He in combination with a second compound selected from the group consisting of $(CF_3)_2O$, $CF_4$, $BF_3$, $GeF_4$, $WF_6$, $SiF_4$, and $PF_3$; and
means for selectively activating said gas mixture to an electrical conductive state.

2. A capacitive energy storage system comprising:
a self-sustained diffuse-discharge closing switch;
a gas mixture in said diffuse-discharge switch comprising Ne in combination with a second compound selected from the group consisting of $(CF_3)_2O$, $CF_4$, $BF_3$, $GeF_4$, $WF_6$, $SiF_4$, and $PF_3$; and
means for selectively activating said gas mixture to an electrical conductive state.

3. A capacitive energy storage system comprising:
a diffuse-discharge switch;
a gas mixture in said diffuse-discharge switch comprising a mixture of He and Ne in combination with a second compound selected from the group consisting of $(CF_3)_2O$, $CF_4$, $BF_3$, $GeF_4$, $WF_6$, $SiF_4$, and $PF_3$; and
means for selectively activating said gas mixture to an electrical conductive state.

4. A capacitive energy storage system comprising:
a diffuse-discharge switch;
a gas mixture in said diffuse-discharge switch comprising He in combination with a second compound selected from the group consisting of $(CF_3)_2O$, $CF_4$, $BF_3$, $GeF_4$, $WF_6$, $SiF_4$, and $PF_3$; in combination with a compound selected from the group consisting of TMPD, TMBI, TMAE, TMAB, triethylamine, methylaniline, diethylamine, aniline, Co-ocene, Ch-ocene, Ni-ocene and Fe-ocene, and means for selectively activating said gas mixture to an electrical conductive state.

5. A capacitive energy storage system comprising:

a diffuse-discharge switch;

a gas mixture in said diffuse-discharge switch comprising Ne in combination with a second compound selected from the group consisting of $(CF_3)_2O$, $CF_4$, $BF_3$, $GeF_4$, $WF_6$, $SiF_4$, and $PF_3$, in combination with a compound selected from a second group consisting of TMPD, TMBI, TMAE, TMAB, triethylamine, methylaniline, diethylamine, aniline, Co-ocene, Ch-ocene, Ni-ocene and Fe-ocene; and means for selectively activating said gas mixture to an electrical conductive state.

6. A capacitive energy storage system comprising:

a diffuse-discharge switch;

a gas mixture in said diffuse-discharge switch comprising Ar in combination with a second compound selected from the group consisting of $(CF_3)_2O$, $CF_4$, $BF_3$, $GeF_4$, $WF_6$, $SiF_4$, and $PF_3$, in combination with a compound selected from a second group consisting of TMPD, TMBI, TMAE, TMAB, triethylamine, methylaniline, diethylamine, aniline, Co-ocene, Ch-ocene, Ni-ocene and Fe-ocene; and means for selectively activating said gas mixture to an electrical conductive state.

7. A capacitive energy storage system comprising:

a diffuse-discharge switch;

a gas mixture in said diffuse-discharge switch comprising a mixture of He, Ne and Ar in combination with a second compound selected from the group consisting of $(CF_3)_2O$, $CF_4$, $BF_3$, $GeF_4$, $WF_6$, $SiF_4$, in combination with a compound selected from the group consisting of TMPD, TMBI, TMAE, TMAB, triethylamine, methylaniline, diethylamine, aniline, Co-ocene, Ch-ocene, Ni-ocene and Fe-ocene; and means for selectively activating said gas mixture to an electrical conductive state.

* * * * *